US005200001A

United States Patent [19]

Hirosawa et al.

[11] Patent Number: 5,200,001

[45] Date of Patent: Apr. 6, 1993

[54] PERMANENT MAGNET

[75] Inventors: Satoshi Hirosawa, Nagaokakyo; Atsushi Hanaki, Kobe; Hiroyuki Tomizawa; Shuji Mino, both of Ibaraki, all of Japan

[73] Assignee: Sumitomo Special Metals Co., Ltd., Osaka, Japan

[21] Appl. No.: 619,642

[22] Filed: Nov. 29, 1990

[30] Foreign Application Priority Data

Dec. 1, 1989 [JP] Japan ..... 1-313945

[51] Int. Cl.[5] ..... H01F 1/053

[52] U.S. Cl. ..... 148/302; 420/83; 420/121; 75/244

[58] Field of Search ..... 148/302; 420/83, 121; 75/244

[56] References Cited

U.S. PATENT DOCUMENTS 4,773,950 9/1983 Fujimura et al. ..... 148/302
4,814,139 3/1989 Tokunaga et al. .

FOREIGN PATENT DOCUMENTS 0125347 11/1984 European Pat. Off. ..... 148/302
0311049 4/1989 European Pat. Off. ..... 148/302
0344542 12/1989 European Pat. Off. .
0362805 4/1990 European Pat. Off. .
60-32606 2/1985 Japan .
61-34242 8/1986 Japan .
62-165305 7/1987 Japan ..... 148/302
1-220803 9/1989 Japan .

OTHER PUBLICATIONS

M. Endoh et al., "Magnetic Properties and Thermal Stabilities of Ga Substituted ND-Fe-Co-B Magnets", *IEEE Trans. on Magnetics*, vol. MAG-23, No. 5, p. 2290 (Sep. 1987).

X. Shen et al., "The effect of molybdenum on the magnetic properties of the ND-Fe-Co-B system", *J. Appl. Phys.*, 61 (8), p. 3433 (1987).

Liu Guozeng et al., "Effect of Mo Addition on the Magnetic Properties and Thermal Stability of Sintered (PrNd)-Fe-Co-Al-B Magnet", AG-23, paper distributed at Kyoto, Japan in May 1989.

IEEE Transactions of Magnetics, vol. 25, No. 5, Sep. 1989, N.Y. US, pp. 3770-3772; W. Rodewald & P. Schrey: "Structural and Magnetic Properties of Sintered Nd14.4Fe67.0-xCo11.8MoxB6.8 Magnets".

Patent Abstracts of Japan, vol. 12, No. 82 (C-481)(2929) Mar. 15, 1988, and JP-A-62 218543 (Seiko) Sep. 25, 1987.

Proc. 8th Int. Workshop of Rare Earth Magnets 1985 BG pp. 541-552, A. Maocai et al. "Effects of Additive Elements of Magnetic Properties of Sintered Nd-B-Fe Magnet".

IEEE Transactions on Magnetics, vol. 26, No. 5, Sep. 1990, N.Y. US, 1960-1962, S. Hirosawa et al.: "High Coercivity Nd-Fe-B Type Permanent Magnets With Less Dysprosium".

*Primary Examiner*—John P. Sheehan
*Attorney, Agent, or Firm*—Fish & Richardson

[57] ABSTRACT

An anisotropic sintered permanent magnet consists essentially of 12 to 18 at % R, wherein R represents Pr, Nd, Dy, Tb and other rare earth element or elements contained as inevitable impurities provided that $0.8 \leqq (Pr+Nd+Dy+Tb)/R \leqq 1.0$, 5 to 9.5 at % B, 2 to 5 at % Mo, 0.01 to 0.5 at % Cu, 0.1 to 3 at % Al, and balance being Fe. B(x) and Mo(y) are $(x-4.5) \leqq y \leqq (x-3.0)$, and part of Fe may be replaced by Co to be 3-7 at % Co. Up to 90 at % of Mo may be replaced by V. The magnet is characterized by main tetragonal $R_2(Fe, Mo)_{14}B$ or $R_2(Fe, Co, Mo)_{14}B$ phase and boundary phase of (Fe, Mo)-B, or (Fe, Co, Mo)-B and $R_m(Fe, Co, Mo)_n$ where $m/n = \frac{1}{2}$ to 3/1. B-rich phase $Nd_{1+\epsilon}Fe_4B_4$ disappears. Dy and/or Tb linearly increase iHc. High coercivity and maximum energy product are obtained: iHc ≧ 15 kOe (or 21 kOe) and (BH)max ≧ 20 MGOe (or 28 MGOe) with high corrosion resistance and high pulverizability of alloy.

26 Claims, 7 Drawing Sheets

PERMANENT MAGNET

FIELD OF THE INVENTION

This invention relates to an Fe-B-R permanent magnet which is not demagnetized when built into, for example, an electric motor for an automotive vehicle and used in a high temperature atmosphere. More particularly, it relates to a permanent magnet containing Mo, Al and Cu as essential elements and scarce and expensive heavy rare earth elements, such as Dy or Tb, as inessential elements and exhibiting superior alloy pulverizability and corrosion resistance as well as high coercivity with a high maximum energy product.

BACKGROUND OF THE INVENTION

A permanent magnet material is one the crucial electrical and electronic materials employed in a wide range of technical fields from domestic electrical appliances to automotive vehicles, communication equipment and peripheral or terminal devices of electronic computers.

In keeping up with the recent demand for high performance and small size in electrical and electronic appliances, high performance is also demanded of permanent magnets. Although the rear earth-cobalt magnet has been conventionally known as a kind of permanent magnet capable of meeting such demand, such rare earth cobalt magnets are required as much as 50 to 60 wt % of cobalt and a large amount of Sm, which is contained in only minor amounts in rare earth ores and is expensive.

In our recent investigations, a ternary compound containing from, boron, and rare earth elements R as essential elements has been found, in which Sm and Co, scarce in natural resources and hence expensive, are not contained as essential elements; light rare earth elements; such as Nd and/or Pr, contained relatively abundantly in rare earth ores, are used predominantly as the rare earth elements and in which superior uniaxial magnetic anisotropy and magnetic properties are displayed, have been realized through the use of iron and boron. Based on this finding, an Fe-B-R sintered magnet showing magnetic anisotropy and high permanent magnetic properties has been proposed, which exhibits a maximum energy product far exceeding that of the conventional rare earth cobalt magnet (Japanese Patent Kokoku Publication No. 34242/1986).

On the other hand, the permanent magnets are subjected to an increasing extent to more and more hostile environments, such as increased self-demagnetizing field resulting from the decreased magnet thickness, strong reverse magnetic fields applied from coils or other magnets or high temperatures resulting from increased operating speeds or increased loads applied to devices or apparatus making use of the magnets.

It has been known that the Fe-B-R magnetically anisotropic sintered magnet containing Nd and/or Pr as the rare earth elements is not affected by slight changes in the composition or the method of production and has a substantially constant temperature coefficient of the coercivity iHc about equal to 0.6%/°C.

Hence, a still higher coercivity is required of the permanent magnet to be employed in such hostile environments.

The assignee of the present application has also proposed an Fe-B-R permanent magnet in which heavy rare earth elements such as Dy and/or Tb are used as a part of R to meet the demand for high coercivity (Japanese Patent Kokai Publication No. 62 32306/1985).

The above mentioned sintered magnet, which exhibits a markedly high coercivity without having a reduced maximum energy product, may also be obtained if the small or trace amounts of impurities contained in industrial level starting materials, such as Al, Si, Cu, Cr, Ni, Mn or Zn, are adjusted, and the starting material so adjusted is subjected to predetermined heat treatment (Japanese Patent Kokai Publication No. 220803/1989).

SUMMARY OF THE INVENTION

The above mentioned permanent magnet containing heavy rare earth elements, such as Dy and/or Tb, is unbeneficial for industrial production, since Dy and Tb are contained only in minor amounts in rare earth ores and expensive.

For increasing coercivity without employing these expensive rare earth elements, there have been proposed a method of adding additional elements M, such as V, Cr, Mn, Ni, Mo or Zn (Japanese Patent Kokai Publication No. 89401/1984) and a method of increasing the amounts of rare earth elements, such as Nd and/or Pr, and boron (Japanese Patent Kokoku Publication No. 34242/1986).

Although, the method of using the additional transitional elements M has the marked effect on increasing the coercivity by the addition of 1 to 2 atomic percent of M, addition of more amounts of M for attempting further increase of the coercivity results in very little increase in coercivity. In addition, many elements of M form nonmagnetic borides with boron to lower the maximum energy product acutely. On the other hand, an increase in the amount of the rare earth elements or boron is thought to cause a gradial increase in coercivity and an acute lowering in the maximum energy product, as in the case of increasing the amount of M.

On the other hand, in keeping up with the tendency towards high performance and the shift of the composition of the Fe-B-R permanent magnet towards low R and low B compositions, Fe primary crystals are precipitated in the ingot, which causes pulverizability.

Besides, the Fe-B-R permanent magnets containing rare earth elements and iron, which are susceptible to oxidation in air and to gradual formation of stable oxides, are inferior in corrosion resistance. Although this problem may be eliminated to some extent by the above mentioned addition of Co, the initial magnetic properties are lowered and become unstable in the corrosion resistance tests under the conditions of a temperature of 80° C. and a relative humidity of 90 percent. This is due to the tendency that the addition of Co also results in lowered coercivity iHc and flexural strength.

It is a principal object of the present invention to provide an Fe-B-R permanent magnet in which the above mentioned problems are eliminated, that is in which the presence of the expensive heavy rare earth elements are not essential, the maximum energy product is not acutely lowered with increase in the coercivity and maintained at 20 MGOe or higher, the coercivity is high with at least 15 kOe, the coercivity is not acutely lowered by an addition of Co and excellent pulverizability of the magnet alloy and excellent corrosion resistance are exhibited.

In achieving our invention we have found:

that addition of Mo results in improved fining of the Fe primary crystal grains in the ingot and in improved pulverization efficiency;

that addition of Mo, Al and Cu in combination in a prescribed relation of concentrations between Mo and B results in high coercivity iHc and in an increased temperature range within which this high iHc may be exhibited;

that addition of Mo, Al and Cu in combination under a prescribed relation of concentrations between Mo and B results in the provision of a specific Co concentration range within which high iHc may be exhibited;

that the effect of the addition of Mo, Al and Cu in combination is cumulative with the effect of Dy, resulting in further increasing iHc by 5 kOe, while the amount of addition of Dy may be decreased significantly (Dy increases iHc at a rate of 2 kOe per weight percent); and that the Fe-B-R permanent magnet containing Mo, Al and Cu as essential elements exhibits a maximum energy product of 20 MGOe or higher and a high coercivity of 15 kOe or more, while having excellent pulverizability of the magnet alloy and excellent in corrosion resistance. Such findings have led to the present invention.

Thus a primary aspect of the present invention resides in a permanent magnet consisting essentially of:

12 to 18 atomic percent of R, wherein R represents at least one of, Pr, Nd, Dy and Tb, and other rare earth element or elements contained as inevitable impurities, provided that $0.8 \leqq (Pr+Nd+Dy+Tb)/\text{Total } R \leqq 1.0$, 5 to 9.5 atomic percent of B;

2 to 5 atomic percent of Mo;

0.01 to 0.5 atomic percent of Cu;

0.1 to 3 atomic percent of Al; and the balance being essentially Fe.

According to another aspect of the present invention, if the amount of B in atomic percent is designated x and the amount of Mo in atomic percent is designated y, the relation between B and Mo concentrations is such that $$(x=4.5) \leqq y \leqq (x-3.0).$$

Also, according to a further aspect of the present invention, not more than 90 percent of Mo is replaced by V.

Also, according to a still further aspect of the present invention, Fe is partially replaced by Co in a Co amount of 3 to 7 atomic percent.

Particularly, the present invention provides an anisotropic sintered permanent magnet in which alloy powders are press-molded (compacted) in a magnetic field and sintered to produce a anisotropic sintered body, and the sintered body thus produced is heat-treated. The improved sintered permanent magnet can be obtained through a specific process based on the compositional features as set forth hereinabove.

The permanent magnet obtained in accordance with the present invention has the maximum energy product of 20 MGOe or more and coercivity of 15 kOe or higher, while it is not demagnetized at elevated temperatures of 150° C. or higher and exhibits stable magnetic properties.

The amount of addition of Dy and/or Tb, which has been conventionally necessitated to obtain high coercivity, may be reduced to about one-half or two-thirds and the efficiency of the pulverizing step for producing alloy powders is improved so that a permanent magnet stable at elevated temperatures and excellent in corrosion resistance may be produced at reduced costs.

DETAILED DESCRIPTION OF THE INVENTION

Figure 1:
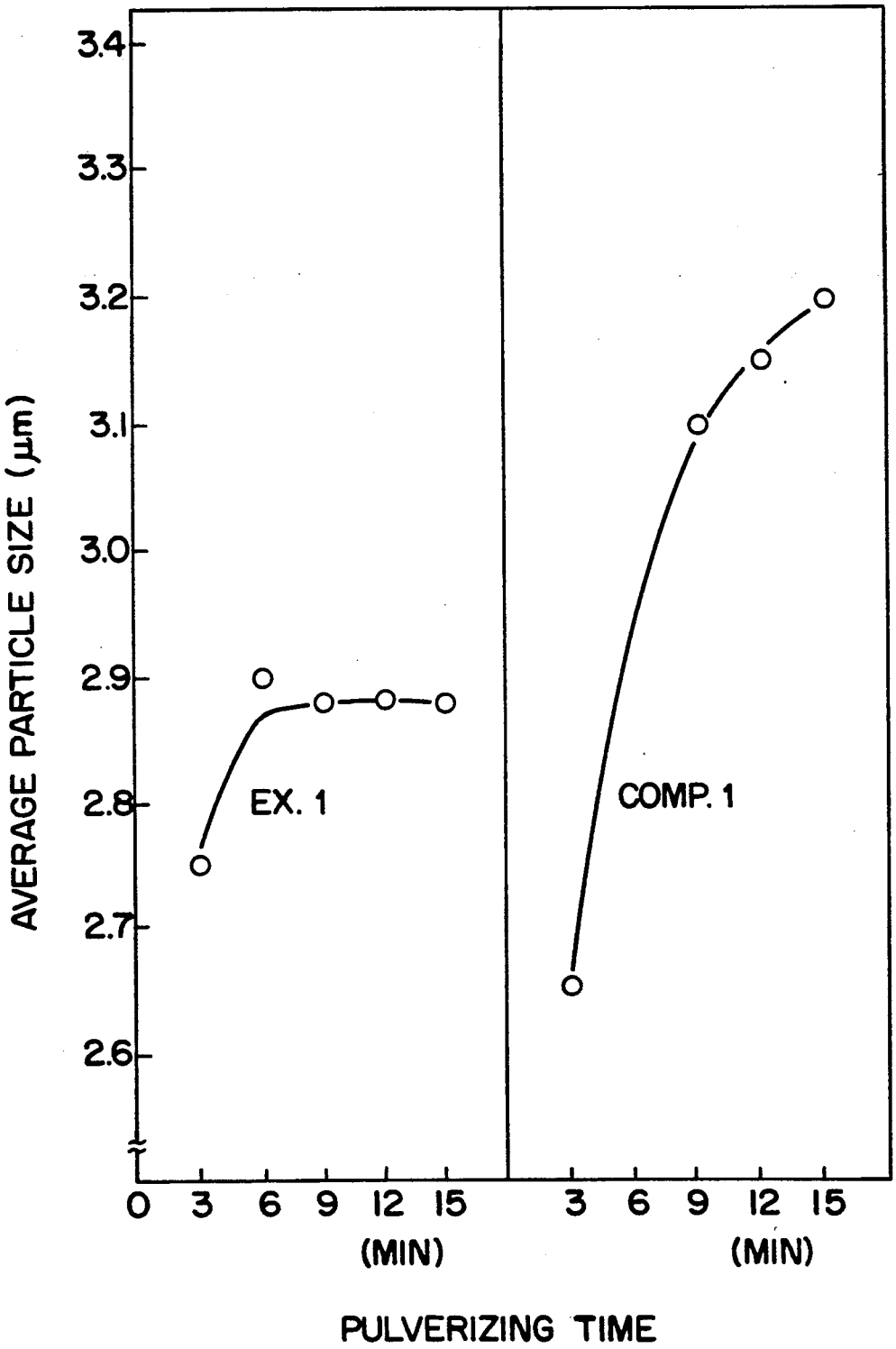
FIG. 1 is a chart showing the relation between the pulverization time duration and the mean particle size according to Example 1.

According to the present invention, the rare earth elements R are Pr, Nd, Dy, Tb and other rare earth elements, generally denoted (La, Ce, Sm, Gd, Ho, Er, Tm, Ym, mainly of La, Ce) contained as impurities, on the condition that the equation $0.8 \leqq (Pr+Nd+Dy+Tb)/\text{Total } R \leqq 1.0$, including the case where R entirely consists of Pr and/or Nd, is satisfied. In many cases, it suffices to use one or both of Pr and Nd. However, a mixture of the above mentioned rare earth elements may also be used, depending on the state of availability of the starting material. Thus a mixture of at least one of Nd and Pr (preferably Nd) and at least one of Dy and Tb (preferably Dy) has the practical importance.

The amount of R is selected to be in the range from 12 to 18 atomic percent since, if it is lower than 12 atomic percent, the high coercivity of 15 kOe or higher, characteristic of the present invention, is not achieved, whereas, if it is higher than 18 atomic percent, the residual magnetic flux density (Br) is lowered and hence the (BH)max of 20 MGOe cannot be realized.

The amount of R in the range from 15 to 17 atomic percent is most preferred since the coercivity of 18 kOe or higher may then be obtained without lowering the (BH)max.

Although solely Nd and/or Pr as R is the present invention are responsible for high coercivity of the permanent magnet, with heavy rare earth elements being not essential, minor amounts of Dy and/or Tb may be substituted for Nd and/or Pr, if necessary, for further increasing the coercivity.

Even a small amount of Dy and/or Tb is effective to increase the coercivity. Since the presence of Nd and/or Pr already gives rise to the effect equivalent to or better than those obtained by conventional positive addition of Dy and/or Tb as mentioned hereinbefore. Therefore, the upper limit of addition of Dy and/or Tb is set to 3 atomic percent. The addition of Dy serves to increase iHc at a rate of 2 to 2.4 kOe per one weight percent Dy (4.7 to 5.6 kOe per atomic percent), whereas (BH)max decreases at a rate of 1 to 1.3 MGOe per one weight percent Dy. This tendency and the expensive cost of Dy, Tb require this upper limitation.

However, the effect of Dy and/or Tb may be generally expressed as follows: iHc (kOe)$\geqq 15+\alpha x$ ($4.7 \leqq \alpha \leqq 5.6$) where x represents the amount of heavy rare earth elements Dy and/or Tb. Here, $0<x\leqq 5$ will satisfy the requirement of (BH)max of at least 20 MGOe.

Although 5 atomic percent or more of B need be added in the present invention to realize the maximum energy product of not less than 20 MGOe and the coercivity of not less than 15 kOe, the amount of B is selected to be in the range from 5 to 9.5 atomic percent because the residual magnetic flux density tends to be lowered if the amount of B exceeds 9.5 atomic percent.

By adding Mo in accordance to a feature of the present invention, the B-rich phase ($R_{1+\epsilon}Fe_4B_4$ where R=rare earth elements mainly of Nd and/or Pr) disappears, whereas the phases shown by, when Co is present, following phases become prevalent:

main tetragonal phase: $R_2$ (Fe, Co, Mo)$_{14}$B (Mo is very small amount)

boundary phases surrounding the main tetragonal phase

R-rich phase mainly of $(LRE)_3Co$ where LRE is light rare earths:

$R_m$(Fe, Co, Mo)$_n$ (m/n=½-3/1)

$RO_x$ (R=mainly Nd, Pr) (x=1-1.5)

B-rich phase: (Fe, Mo, Co)$_{1.5-2}$B (Most of Mo is present here) (mainly of $Mo_2FeB_2$)

wherein the underlined element represents the majority element in each phase. When Co is not present, the phases are:

main tetragonal phase: $R_2$(Fe, Mo)$_{14}$B boundary phases

B-rich phase: mainly of $Mo_2FeB_2$

R-rich phase: mainly of (LRE) metals, and (LRE) oxides.

On the other hand, the high iHc may be realized over an increased wide range of temperatures, such that the lowering in iHc due to the addition of Co may be avoided. As for the B-rich phase $R_{1+\epsilon}Fe_4B_4$ the value of $\epsilon$ is 21/19 to 31/27. (Refer to H. F. Brawn et al, Proc. VII Inter. Conf. of Solid Compounds of Transition Elements, Grenoble (1982) II, B11)

As the $R_m$(Fe, Co, Mn)$_n$ phase, binary R-Co compounds $R_3Co$ predominantly occur at a range of $0<Co\leqq 6$ atomic percent (In this phase a very small amounts of Fe, Mo and Dy are detectable) but the majority is (Pr, Nd) and Co. At a greater Co amount, $R_7Co_3$ and $R_3Co$ are predominant.

In addition, the resistance to moisture becomes twofold, while iHc may be improved without resorting to Dy. Since the B-rich phase disappears and R becomes redundant, with Dy and (Nd and/or Pr) being distributed to a greater extent to the main phase and to the R-rich phase, respectively, so that, as a result of concentration of Dy in the main phase, the effect of addition of Dy may be enhanced. The Dy concentration in the R of the R-rich phase was observed only at 2 atomic percent or less of the entire R.

The amount of Mo in excess of 2 atomic percent is necessary for realizing the above effect. On the other hand, if the amount of Mo exceeds 5 atomic percent, it becomes desirable to increase the concentration of B with increase in the amount of Mo, as will be explained subsequently. As a result, the maximum energy product is decreased to less than 20 MGOe. Hence, the amount of Mo is selected to be in the range from 2 to 5 atomic percent.

The amount of B in the range from 6 to 8 (or further 7 to 8) atomic percent is most desirable since the coercivity of 17 kOe without addition of Dy or higher with addition of Dy and the maximum energy product of 28 MGOe or higher may be realized at room temperature.

Although Cu need be added in an amount of 0.01 atomic percent or more for improving the coercivity, the amount of Cu is selected to be in the range from 0.01 to 0.5 atomic percent since the addition of Cu in an amount in excess of 0.5 atomic percent results in the deteriorated squareness of the demagnetization curve. Therefore, the amount of Cu is selected to be in the range from 0.01 to 0.5 atomic percent. The optimum squareness of the demagnetization curve may be obtained by the addition of Cu in an amount of 0.02 to 0.2 (further 0.02 to 0.09) atomic percent. The presence of Cu up to 0.3 atomic percent improves the coercivity at as-sintered state.

Although Al need be added in an amount of 0.1 atomic percent or more for improving the coercivity as described above (by about 6.6 kOe/at % up to 1.3 at % Al, above which increase rate slightly dimishes), addition of Al in an amount in excess of 3 atomic percent results not only in a lowered maximum energy product but in a marked lowering in the Curie temperature Tc and in a marked deterioration in the thermal stability. Therefore, Al is selected to be in the range from 0.1 to 3 atomic percent. The Tc decreases at a rate of about 10° C. while (BH)max decreases at a rate of about 2.6 MGOe, each per atomic % Al.

In the present invention, if the amount of B is excessive as compared to that of Mo, the B-rich phase ($R_{1+\epsilon}Fe_4B_4$) is increased, so that the effect of increasing the coercivity brought about by the addition of Mo cannot be obtained. However, if the amount of B is small, the $R_2Fe_{17}$ phase appears degrading the squareness of the demagnetization curve.

Therefore, if the proportion of the amounts between B and Mo given by the formula $$(x-4.5)^{*} \leqq y \leqq (x-3.0)^{**}$$

* (determined by iHc)
** (determined by Br and (BH)max)

wherein x denotes the amount in atomic percent of B and y the amount in atomic percent of Mo, is satisfied, the high iHc, high (BH)max and high squareness may be realized simultaneously, thus more preferred.

Although it has been also found that a Nd-Fe-Dy-B-V-Co permanent magnet obtained by addition of V-Co results in increased coercivity, the composition if the definitive phases becomes similar to the low-B composition due to the strong bonding between V, Fe and B, so that more Fe in the ingot is precipitated than in the case of the conventional alloy, and hence difficulties are present in pulverizing the alloy ingot.

Mo and V are mutually replaceable in view of coercivity effect. However, in order to suppress occurence of the Fe primary crystal to a level such that will not deteriorate the pulverizability, Mo should be present in an amount of at least 90% of (Mo+V). Namely, by substituting V for 10 atomic percent or less of the entire Mo, the effect of the improved coercivity and the effect of fining of the Fe primary crystal grains in the ingot may be achieved simultaneously maintaining satisfactory pulverizability. This is thought to be due to the contribution of Mo shifting the liquidus line of primary Fe crystallization toward Fe-rich composition, whereas V shifts the liquidus line toward Fe-poor composition so that practically important compositions for permanent magnet fabrication is entirety covered within a region where the primary Fe crystallizes as large dendrites when V is incorporated.

Although Co has the effect of raising the Curie temperature of the Fe-B-R permanent magnet and improving the corrosion resistance as well as temperature characteristics of the residual magnetic flux density, addition of Co results in an undesirably lowered iHc. However, with the addition of Mo, Al and Cu in combination with Co in an amount of 3 to 7 atomic percent, a high iHc may be achieved. An amount of 4 to 6 atomic percent is most preferred for realizing a still higher iHc.

On the other hand, addition of one or more of Co, Cr and Ni so that the sum total accounts for 0.5 atomic percent or more, the amount of oxidation during the step of handling fine powders can be advantageously educed. If Cr is added further in an amount of 1 atomic percent or more, the corrosion resistance of the alloy powders and the product magnet is improved significantly.

With the permanent magnet of the present invention, Fe accounts for the balance of the sum of the above mentioned elements.

During production of the permanent magnet according to the present invention, $O_2$ or C may be included in the sintered body, depending on the production process. That is, these substances may be mixed from the process steps of raw materials, handling, melting, pulverization, sintering, heat-treatment and the like. Although an oxygen amount up to 8,000 ppm of these substances is not deleterious to the effect of the invention, it is preferably maintained in an amount of not more than 6,000 ppm.

C may also be mixed in rom the raw materials or derived from the intentionally added substances such as the binder or lubricant for improving moldability of the powders. Although the carbon content of up to 3,000 ppm in the sintered body is not deleterious to the effect of the present invention, the carbon content is preferably 1,500 ppm or less.

Production Process

The permanent magnet of the present invention having the above described composition exhibits superior magnetic properties not only as the isotropic magnet produced in accordance with the known method such as casting or sintering, but also as the magnetically anisotropic sintered magnet produced by the method hereinafter explained.

First, alloy powders having the Fe-B-R composition as the starting material are produced.

The alloy obtained by usual melting is cast and cooled under conditions which will not produce an amorphous state. The alloy ingot thus produced is crushed and pulverized followed by sieving and/or mixing, to produce alloy powders. Alternatively, alloy powders may be produced from oxides of rare earth elements by the coreduction (or direct reduction) method.

The mean particle size of the alloy powders is in the range from 0.5 to 10 μm. The mean particle size of 1.0 to 5 μm is most preferred for realizing superior magnetic properties.

Pulverization may be performed by a wet method in a solvent or by a dry method in $N_2$ or the like gas. However, for realizing higher coercivity, pulverization by a jet mill or the like is preferred since a more uniform particle size of the powders may thereby be obtained.

The alloy powders are then molded by forming (compacting) methods similar to the usual powder metallurgical methods. Pressure molding is most preferred. In order to provide for anisotropy, the alloy powders are pressed, e.g., in a magnetic field of at least 5 kOe under a pressure of 0.5 to 3.0 ton/cm$^2$.

The formed body is sintered in an ordinary reducing or non-oxidizing atmosphere at a prescribed temperature in the range of 900° to 1200° C.

For example, the formed body is sintered under a vacuum of $10^{-2}$ Torr or less or under an atmosphere of an inert gas or a reducing gas with a purity of 99% or higher at 1 to 76 Torr at a temperature range of 900° to 1200° C. (preferably above 950° C.) for 0.5 to 4 hours.

For sintering, the operating conditions, such as temperature or duration, need be adjusted for realizing prescribed crystal grain size and sintering density.

A density of the sintered body which is 95 percent or more of the theoretical density is desirable in view of magnetic properties. For example, with a sintering temperature of 1040° to 1160° C., a density of 7.2 g/cm$^3$ or higher is obtained, which is equivalent to 95 percent of the theoretical density or higher. With the sintering temperature of 1060° to 1120° C., a ratio to the theoretical density of 99 percent or higher may be achieved thus preferred.

The so-produced sintered body is heat-treated at 450° to 900° C. for 0.1 to 10 hours. The heat-treating temperature may be maintained constant, or the sintered body may be cooled gradually or subjected to multi-stage ageing within the above range of temperatures.

The ageing is performed in vacuum or under an atmosphere of an inert gas or a reducing gas. For ageing the inventive sintered magnet, a multi-stage ageing may also be performed, according to which the sintered body is maintained at a temperature of 650° to 950° C. (preferably up to 900° C.) for 5 minutes to 10 hours and subsequently heat-treated at a lower temperature (two-stage ageing).

Note, however, the heat treatment such as ageing can be eliminated according to the present invention, particularly due to the copresence of Cu and Al in the specific proportion as discussed in the Examples. This feature is particularly advantageous in view of reduction in the manufacturing steps and cost reduction for the industrial mass-production. The resultant magnets can provide a highest level of iHc (e.g., 28 kOe or above) in the as-sintered state. This coercivity is sufficiently high for specific use at high temperatures generally, as for the resistance to the demagnetization of the imentire magnets at high temperature the temperature-dependent demagnetization rate is 5% or less at 150° C. relative to the room temperature when used at Pc=2 without addition of Dy and/or Tb. The temperature at which the irreversible loss of magnetic flux density appears can be further raised by the addition of Dy and/or Tb, enabling the use at 200° C. or above according to the most preferred embodiments.

It is also preferred that, for improving the corrosion resistance of the magnet, the magnet surface be coated with a resin layer or a corrosion-resistant metal plating layer by electroless or electrolytic plating, or be subjected to an aluminum chromating treatment.

Also it is believed that the presence of certain amount of Si, Cr and/or Mn from 0.01 to 0.2 atomic percent as impurities will serve to stabilize the coercivity.

In the following various points of view in the light of the process aspect will be discussed.

(1) Resultant phase product ($Mo_2FeB_2$) due to the Mo addition is very hard, which serves as pulverizing agent in the jet-milling to provide (a) lowering in the average particle size, and (b) improved pulverizing efficiency, thus, particularly favorable for the jet-milling.

Using ball will, there is difficulty in the pulverization, resulting in a wide distribution of the resulting particle size which is thought to be attributable to the lower iHc. Presumably, the ball-milling cannot completely pulverize the hard phase of $Mo_2FeB_2$. By using the jet-milling which can apply a greater energy for pulverization, but only the hard phase is pulverized but also the hard $Mo_2FeB_2$ particles collide with other particle formed of other phases to further promote the pulverization. The resultant very fine $Mo_2FeB_2$ can serve as a grain growth inhibitor which is distributed at the grain boundary of the main phase (tetragonal). This will result in the high iHc.

(2) A method is proposed in which $(Mo-V)_2FeB_2$ grains are very finely distributed upon precipitation in an ingot, which is further jet-milled with an efficient pulverization, to a finest average particle size for obtaining the highest iHc. The hard particle of the $(Mo-V)_2FeB_2$ phase will serve to pulverize the other alloy phases such as $Nd_2Fe_{14}B$, $NdFe_4B_4$ or Nd-rich phase during circulation in the jet mill to produce a very uniform and fine particles of the phases constituting the magnet.

$(Mo-V)_2FeB_2$ has a high melting point of about 2000° C., thus precipitates as the primary crystal in the cubic or ascicular shape having edges.

(3) There is provided a method in which fine particles (e.g., 1 to 10 μm) of each phase of $(Nd, Dy)_2(Fe, Co)_{14}B$, Nd or $NdH_2$, each phase being substantially single crystalline particles, are uniformly mixed with fine particles of $(Mo-V)_2FeB_2$ phase (e.g., 1–10 μm), thereby inhibiting the grain growth in the sintered magnet. In this manner the inventive permanent magnet can be produced as well. When $NdH_2$ is used, the sintering should be done in vacuum.

(4) There is provided also a method in which the Fe primary crystal is inhibited from precipitating in an ingot of a Nd-Dy-Fe-Co-B base alloy for providing the $(Nd, Dy)_2(Fe, Co)_{14}B$ type ingot or cast alloy of the Nd-Dy-Fe-Co-B-Mo composition. The precipitation of the Fe primary crystal can be inhibited at an B amount of 7 atomic % or less where Nd is 17 atomic %, or at a B amount of 8 atomic % or less where Nd is 13 atomic %.

(5) There is also proposed a method in which the pulverization efficiency and iHc are improved by adding coarse $(Mo-V)_2FeB_2$ powder (50–500 μm) to a coarse alloy powder of a basic composition (50–500 μm), and the mixture is subjected to jet milling to obtain a fine average particle size.

A coarse powder of Nd-Dy-Fe-Co-(V, Mo)-B is obtainable by mixing an alloy powder of Nd-Dy-Fe-Co-(V, Mo)-B in an amount of $(1-w)$ with $(V-Mo)_2FeB_2$ in an amount of w, each on molar base, in which the following applies:

Nd, Dy, Co: $1/(1-w)$ of target composition

Fe: $x_{F\theta}\times 1/(1-w)-0.2w$ (wherein $x_{F\theta}$ is target Fe concentration)

V, Mo, B: $(x_V, x_{M0}, x_B)\times 1/(1-w)-0.4w$ (where $x_V$, $x_{M0}$ or $x_B$ represents target concentration).

(6) Due to the presence of specific small amount (0.02 to 0.3 at %) of Cu in combination of Mo, the highest coercivity iHc can be obtained irrespective of the cooling rate except for the case with a very low cooling rate such as cooling in the furance in the case where Cu is less than 0.2 atomic %, whereas a high iHc is obtaineable irrespective of the cooling rate with Cu of more than 0.2%.

(7) The magnet having high iHc based on the copresence of Mo and Co can be magnetized in a lower magnetizing field of about 4 to 5 kOe than the conventional Nd-Fe-B magnets.

EXAMPLES

Example 1

Using Nd having a purity of 97 wt %, the balance being essentially rare earth elements, such as Pr, electrolytic iron containing each 0.005 wt % or less of Si, Mn, Cu, Al or Cr and, as boron, i) commercially available ferroboron (corresponding to JIS G 2318 FBL1; containing 19.4 wt % of B, 3.2 wt % of Al, 0.74 wt % of Si, 0.03 wt % of C and the balance being other impurities and Fe); ii) commercially available high purity boron, pure Cu and pure Al, an alloy having a composition of $Nd_{14.4}Dy_{1.6}Fe_{67.15}Co_5Mo_{3.85}B_8Cu_{0.06}Al_{0.5}$
(Example 1)

and an alloy having a composition of $Nd_{13.9}Dy_{1.6}Fe_{67.5}Co_5V_4B_8Cu_{0.06}Al_{0.6}$
(Comparative Example 1)

were melted by high frequency melting and cast in a mold to produce ingots.

These ingots were crushed in a motor-driven grinder and pulverized by a jet mill in an $N_2$ gas to produce fine powder with a mean particle size of 2.6 to 3.3 μm.

The relation between the pulverizing time duration following charging of the starting materials at a constant rate prescribed for the jet mill and the particle size of the produced powders was measured.

It is seen from FIG. 1 that, in the case of the present invention added with Mo, even an as-cast ingot entered into the steady-state pulverization in about six minutes, whereas, in the case of a comparative alloy of a comparable composition added with V, the as-cast alloy fails to enter the steady-state pulverization even after 15 minutes of pulverization, that is, the particle size is so coarse that the alloy cannot be pulverized satisfactorily.

Generally, the pulverization proceeds in a jet mill through collision of alloy powders to the inner wall of the jet mill and particle-to-particle collision of the powder in the inactive gas flow at a supersonic speed. If there is a ductile phase such as iron alloy phase in the alloy, the pulverizing efficiency deteriorates markedly. When the material is overfed at a rate in excess of the rate that can be milled by the jet mill, the pulverization does not enter the steady-state pulverization causing exhaustion of unpulverized powders out of the jet mill. This results in stable particle size distribution, entailing increased particle size with the lapse of time. The jet mill used usually enter the steady-state pulverization within about five minutes when operated under normal conditions.

In this regard, the particle size of the milled powder became stable after 6 minutes in the example, whereas the steady state could not be established even at the end of operation in the comparative example. In the latter case, there are powders remaining in the mill without being pulverized (refer to FIG. 5). If the operation is further continued, the remaining powder will be accumulated in the mill finally leading to an inoperable state. In order to avoid such occurence, the feed rate must be diminished to a great extent, which will cause increased pulverization costs. In contrast thereto, the inventive example enables the pulverization at the high performance freed of such problems.

Example 2

An alloy having a composition $Nd_{14.4}Dy_{1.6}Fe_{71-y}Co_yMo_4B_8Cu_{0.09}Al_{0.6}$ (Example 2)

and an alloy having a composition $Nd_{14.4}Dy_{1.6}Fe_{75-y}Co_yB_8Cu_{0.09}Al_{0.6}$ (Comparative Example 2)

were melted, cast and pulverized and the resulting starting powders were pressure molded in a magnetic field of 10 kOe under a pressure of 1.5 ton/cm$^2$. The so-produced compacts were sintered at 1080° C. for three hours and heat-treated at 630° C. for 1 hour.

Figure 2:
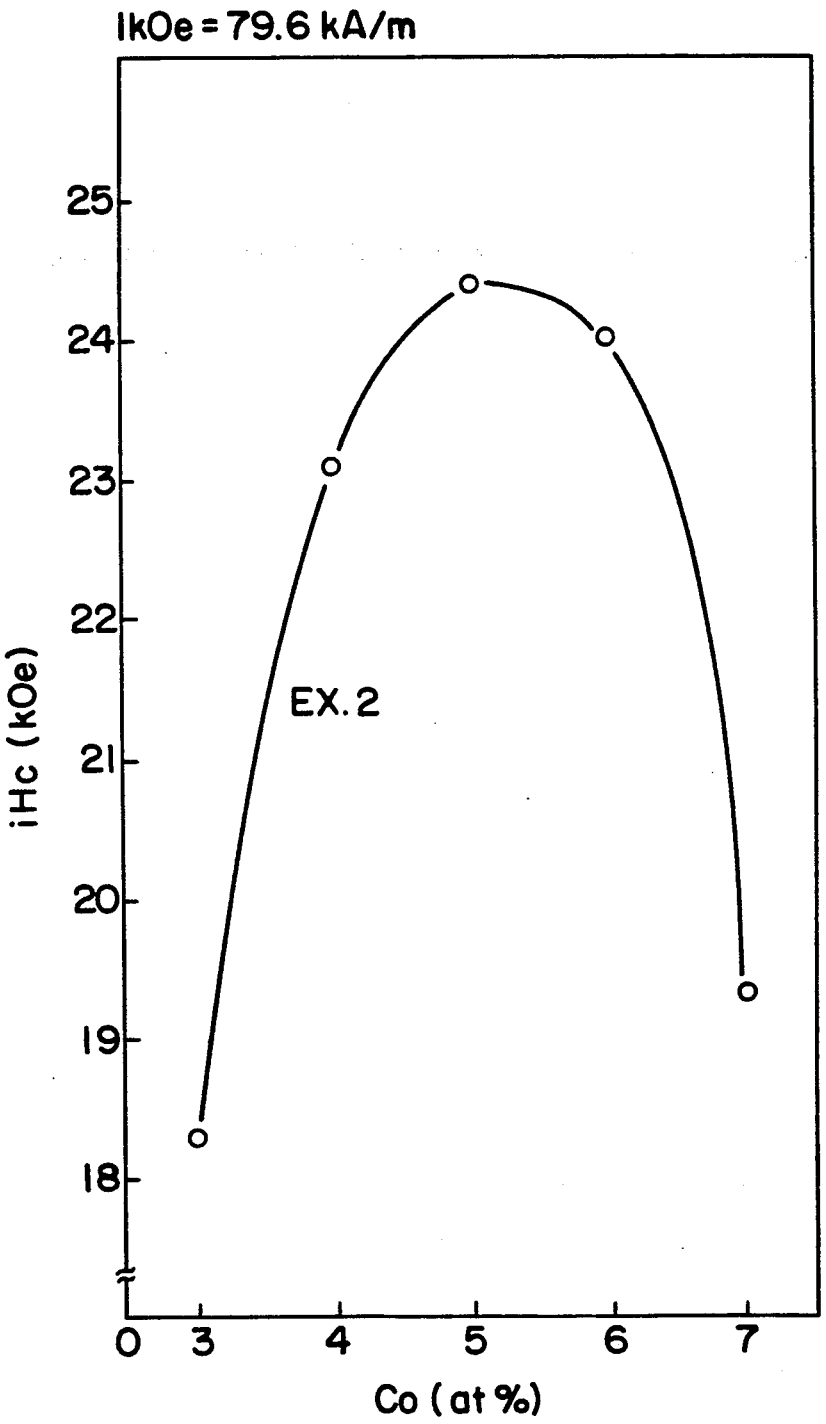
FIG. 2 is a chart showing the relation between the amount of Co and the coercivity iHc according to Example 2.

It is seen from FIG. 2 that the high coercivity not lower than 17 kOe may be obtained with the range of $3 \leqq y \leqq 7$ according to the present invention, whereas iHc falls with y=2 and y=8 to less than 15 kOe which is lower than iHc of the alloy of the Comparative Example 2 containing Dy and not added to by Mo.

Example 3

An alloy having a composition of $Nd_{16-z}Dy_zFe_{67}Co_5Mo_4B_8Cu_{0.07}Al_{0.9}$ (Example 3)

and an alloy having a composition of $Nd_{15-z}Dy_zFe_{77}B_8Co_{0.07}Al_{0.9}$ (Comparative Example 3)

were melted, cast and pulverized in the same way as in Example 1, and pressure molded, sintered and heat-treated in the same way as in Example 2 to produce a permanent magnet.

Figure 3:
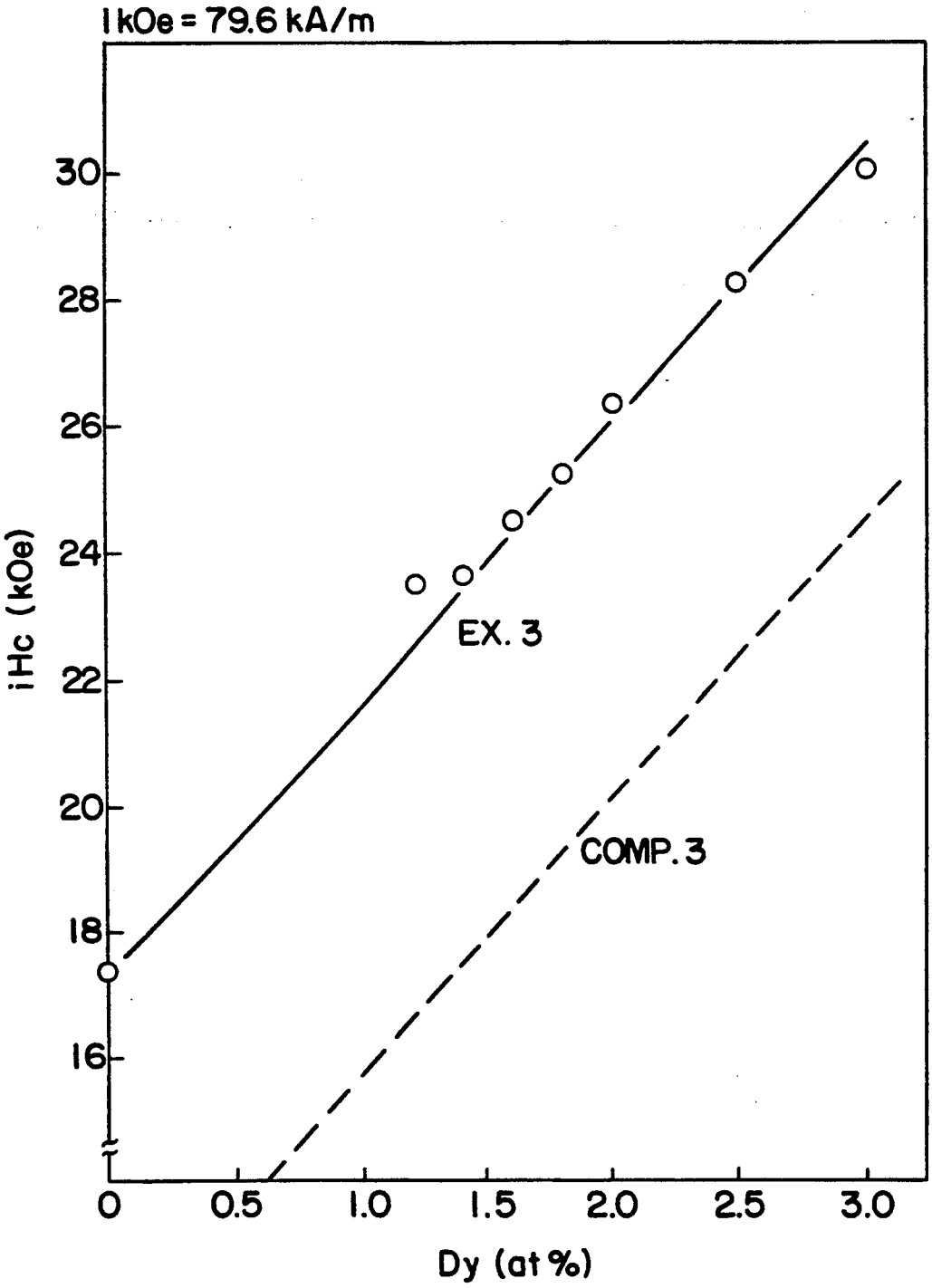
FIG. 3 is a chart showing the relation between the amount of Dy and the coercivity iHc according to Example 3.

It is seen from FIG. 3 that, with the permanent magnet of the present invention, the coercivity iHc is higher by 5 kOe than that in the Comparative Example 3 having the same Dy content through the combined presence of Mo, Cu and Al.

The magnet with Dy=3.0 atomic percent and iHc=30 kOe in the Example 3 of FIG. 3 is not subjected to irreversible loss of magnetic flux density under conditions of the temperature of 200° C. and the operating point of the magnet B/H=1.0.

However, Dy is limited to up to 3.0 atomic percent because of its expense and scarceness in resources. Thus, with the permanent magnet of the present invention, the high coercivity of the defined level may be realized with Nd and/or pr only and the amount of Dy may be selected which will give still higher desired coercivity depending on the use of the magnet.

Example 4

Permanent magnets were produced by the same method as in Example 3 and heat-treated at 600° C. for one hour to produce a sintered magnet having a composition of $Nd_{14.4}Dy_{1.6}Fe_{71-x}Co_5Mo_xB_8Cu_{0.05}Al_{0.8}$ and the magnetic properties of the so-produced magnet were measured. The results are shown in FIG. 4.

Figure 4A:
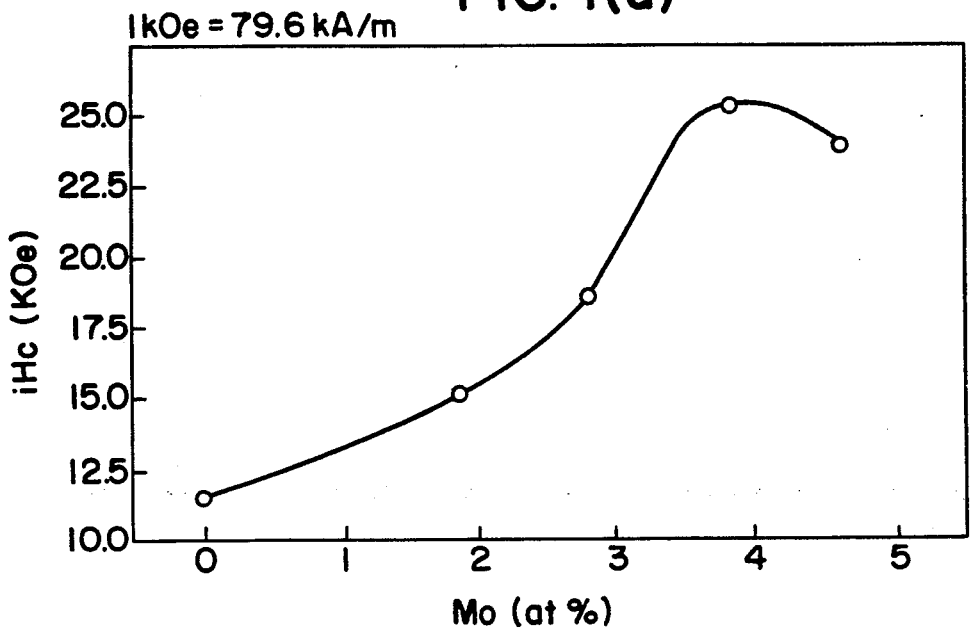
FIGS. 4*a*, *b* and *c* are charts showing the relation between the amount of Mo on one hand and Br, (BH)max and iHc, on the other hand, respectively, according to Example 4.
Figure 4B:
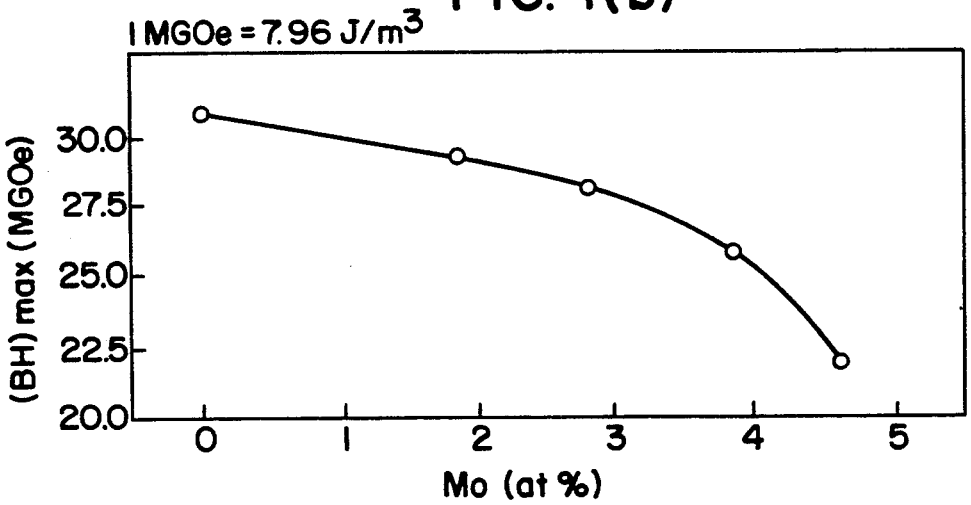
Figure 4C:
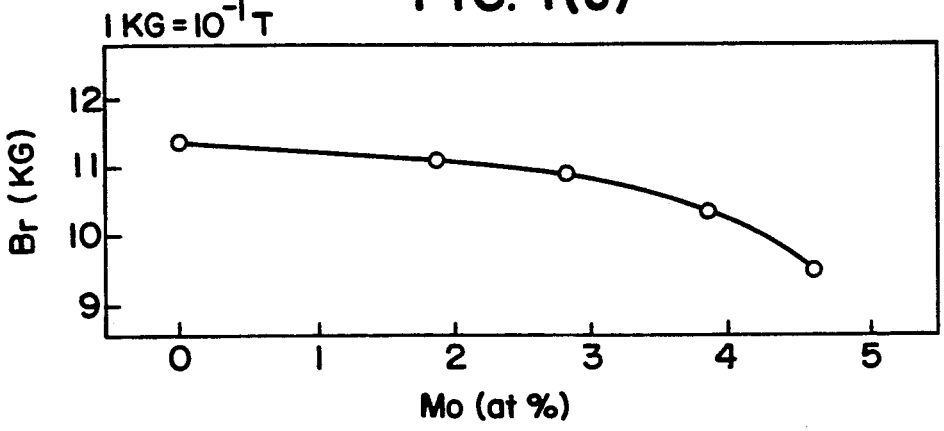

As shown in FIG. 4, iHc is increased acutely with the amount of Mo in excess of 2 atomic percent and becomes 15 kOe or higher reaching a maximum of 25 kOe at about 4 atomic percent. However, if the amount of Mo exceeds 5 atomic percent, (BH)max falls to less than 20 MGOe.

Example 5

The flexural strength of a sintered magnet with a composition of $Nd_{15.5}Dy_{0.5}Fe_{bal}B_6Co_5(Mo_{1-u}V_u)_wCu_{0.02}Al_{0.5}$ produced in the same way as in Example 3 was measure. The results are shown in Table 1.

In evaluation, on each of five samples (n=5) the flexural strength of not less than 24 kgf/mm$^2$ was determined to be acceptable (marked as o) for those all five satisfying this value, and the samples having at least one below this value were determined to be unacceptable (marked as x). The flexural strength was measured by using specimens having a size of thickness t of 3.00 mm, width b of 7.44 mm at a span l of 15 mm through the three-point bending test. The flexural strength S was calculated by the equation $S(kgf/mm^2)=3\times(P(kgf)\times l(mm)/2\times b(mm)\times[t(mm)]^2$ where P is load at fracture. The specimen was finished to a smooth surface using a diamond grinder.

TABLE 1

| | | Composition | | |
|---|---|---|---|---|
| | No. | V(u) | (Mo + V)(w) | Evaluation |
| Comp. Ex. | C1 | 0 | 0 | x |
| | C2 | 0 | 0.5 | x |
| | C3 | 0 | 1.0 | x |
| Inventive | 51 | 0 | 2.0 | o |
| | 52 | 0 | 3.0 | o |
| | 53 | 0.5 | 3.0 | o |
| | 54 | 0.5 | 2.0 | o |
| | 55 | 0.5 | 3.0 | o |
| | 56 | 0.9 | 2.0 | o |
| | 57 | 0.9 | 3.0 | o |

Example 6

Figure 5:
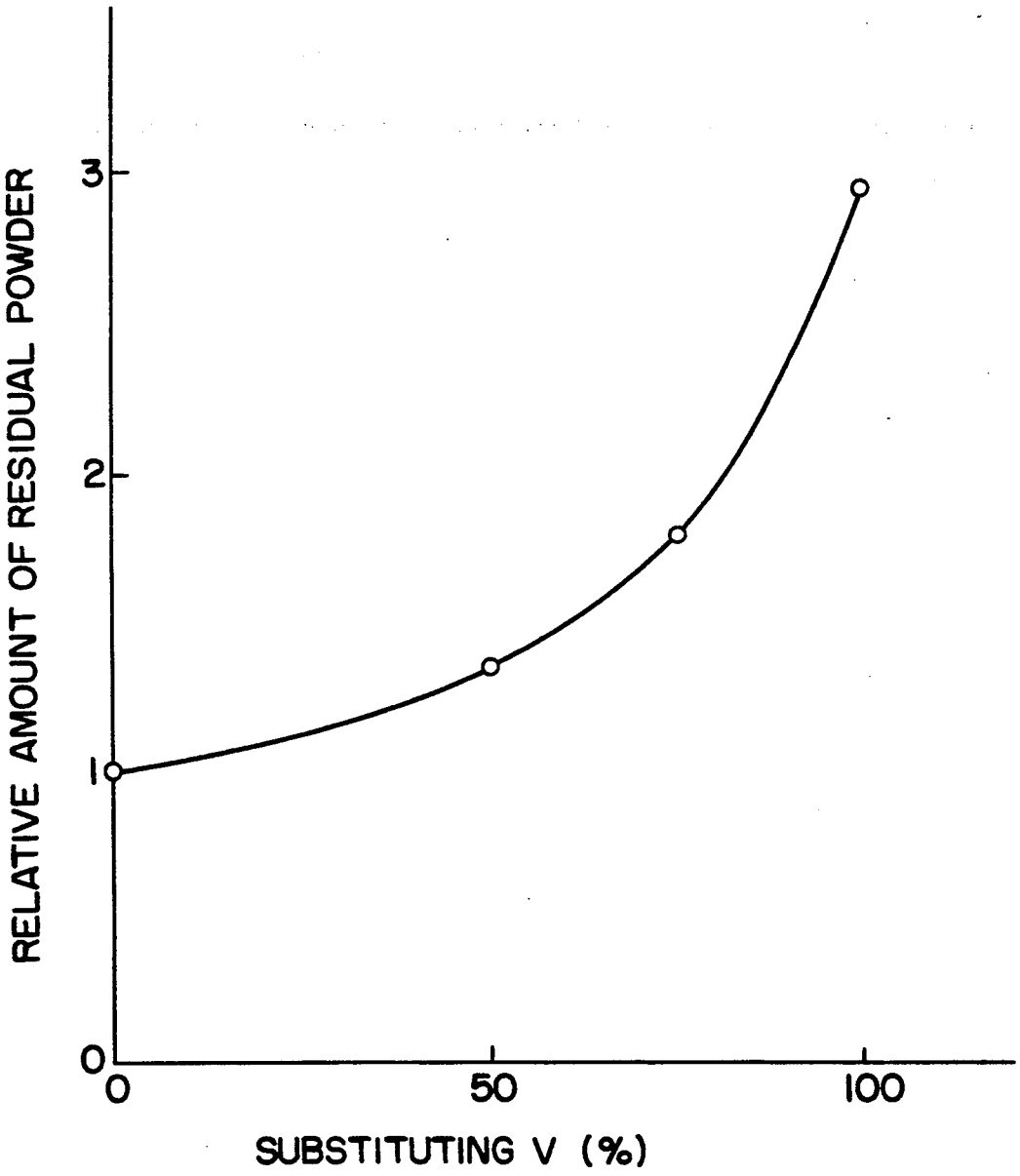
FIG. 5 is a chart showing the relation (relative ratio) between the amount of residual powders v and the specific amount of residual powders according to Example 6.

An alloy having a composition of $Nd_{14.4}Dy_{1.6}Fe_{71-(x+y)}Co_5Mo_xV_yB_8Cu_{0.05}Al_{0.8}$ was melted, cast and pulverized in the same way as in Example 1 and, provided that Mo(x) in the alloy composition was 0 to 4 atomic percent and replaced by 4 to 0 atomic percent of V(y). Upon pulverization, the amount of the powders which remained in the jet mill without being pulverized was measured. FIG. 5 shows the relation between the amount of substitution by V and the relative amount of the residual powders in the jet mill. It is seen that improved fine pulverizability results with increase in the amount of Mo not replaced by V. The relative residual powder amount represents a ratio of the residual powder amount (weight %) when Mo is replaced by V in different percentages (weight %) of V relative to that when only Mo is present.

The replacement of Mo by V may be done in view of further points as follows: V slightly improves the temperature coefficient of Br and iHc over the case of Mo alone. When Mo is completely replaced by V, this temperature coefficient increases at a rate of 0.01%/°C. (i.e., a difference of 1.8% at 200° C.). Additionally, V is more abundant in resources than Mo.

Example 7

A sintered magnet having a composition of $$Nd_{11}Pr_3Dy_{1.6}B_xMo_yCo_5Fe_{bal}Cu_{0.04}Al_{0.7}$$

was produced in the same way as in Example 3, and the coercivity iHc and magnetic properties of the so-produced sintered magnet were measured at room temperature.

It is seen from Table 2 that the high coercivity iHc may be obtained only in the range of $y \leqq x-3.0$ while the high $H_k$ may be obtained only in the range of $x-4.5 \leqq y$. High magnetic properties may be obtained in the range of $(x-4.5) \leqq y \leqq (x-3.0)$, which is preferred.

TABLE 2

| Sample No. | Composition Mo (y) | Composition B (x) | Magnet Properties (BH)max (MGOe)* | iHc (kOe)** | Hk (kOe) |
|---|---|---|---|---|---|
| 71 | 3.0 | 7.0 | 27.9 | >25.9 | 18.36 |
| 72 | 3.5 | 7.0 | 24.7 | 25.43 | 13.80 |
| 73 | 4.0 | 7.0 | 22.6 | >21.0 | 12.08 |
| 74 | 3.0 | 7.5 | 27.8 | 18.87 | 17.27 |
| 75 | 3.5 | 7.5 | 26.2 | >26.1 | 17.98 |
| 76 | 4.0 | 7.5 | 23.5 | >26.1 | 13.98 |
| 77 | 3.0 | 8.0 | 27.6 | 17.63 | 12.81 |
| 78 | 3.5 | 8.0 | 24.6 | >21.1 | 15.8 |
| 79 | 4.0 | 8.0 | 24.3 | >26.0 | 15.11 |

*1 MGOe = 7.96 kJ/m$^3$
**1 kOe = 79.6 kA/m

Example 8

A sintered magnet having a composition of $$Nd_{14.4}Dy_{1.67}Fe_{71-x}Co_5Mo_xB_8Cu_{0.06}Al_{0.8}$$

was produced in the same way as in Example 3. The magnet so produced was put to a durability test of allowing the magnet to stand for 100 hours under the conditions of a temperature of 80° C. and a relative humidity of 90 percent, and the weight gain rate ($\Delta W/Wo$) per unit area was measured.

Figure 6:
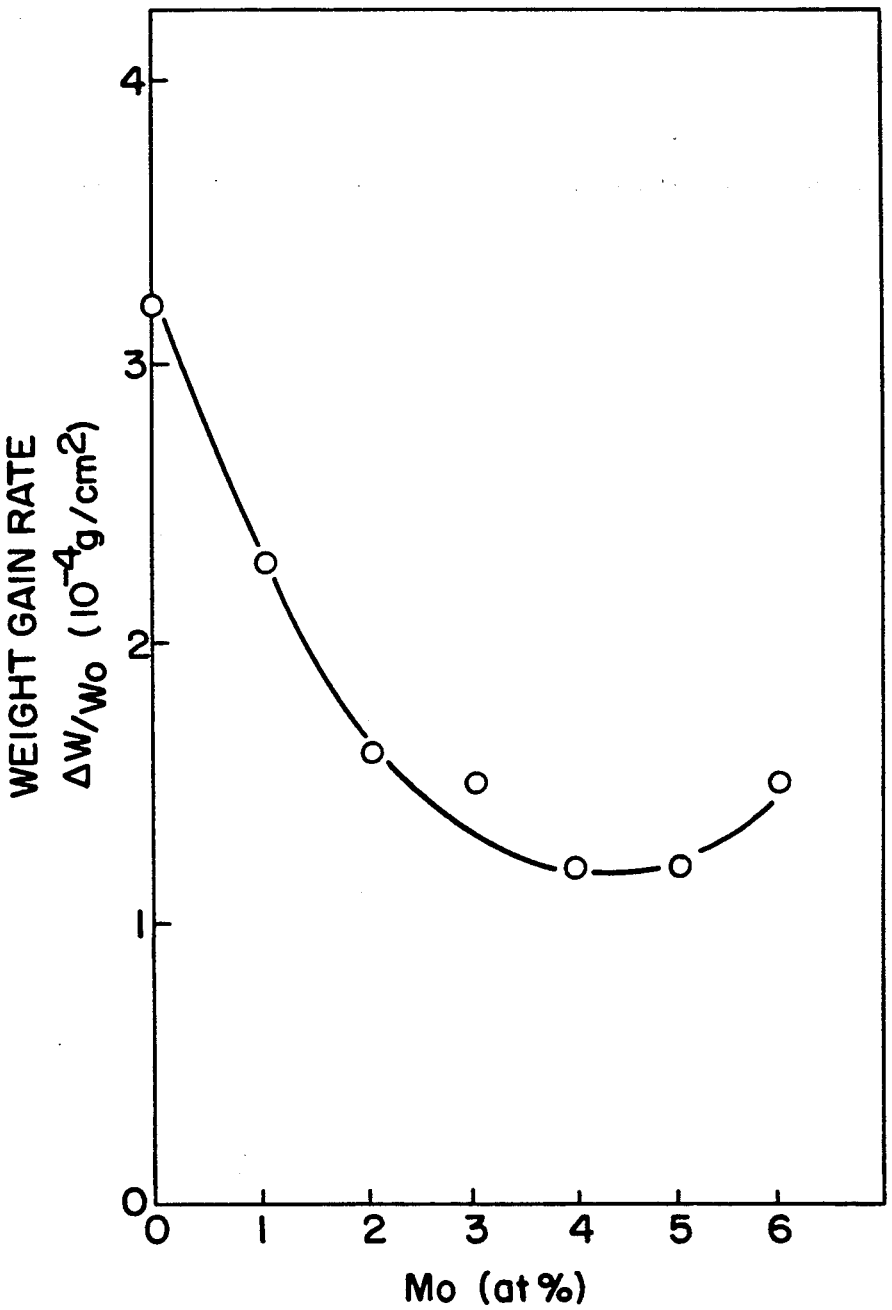
FIG. 6 is a chart showing the relation between the amount of Mo and the weight gain rate $\Delta W/Wo$ according to Example 8.

It is seen from FIG. 6 that addition of Mo leads to resistance to moisture.

The weight gain rate offers a measure for the speed of generation of oxidation products. The presence of Co (5 atomic percent) markedly increases the corrosion resistance, while the presence of Mo further enhances the moisture resistance. FIG. 6 shows its dependence to the Mo concentration in which the weight gain rate, which usually increases through rusting under high temperature/humidity conditions, decreases, thus resulting in the improved humidity resistance. This is considered that the active B-rich phase rare earth elements (Nd, Pr) has been replaced by the (Mo, Fe)-B phase ($Mo_2FeB_2$) which contains no light rare earth elements.

Example 9

The magnetic properties of sintered magnets of an alloy composition (I) of $Nd_{16}Fe_{bal}B_8Mo_4Cu_xAl_y$ and an alloy composition (II) of $Nd_{14.4}Dy_{1.6}Fe_{bal}B_8Mo_4Cu_x$-$Al_y$, produced in the same way as in Example 3, were measured.

It may be seen from Table 3 that Cu and Al represent crucial constituent elements of the permanent magnet of the present invention.

TABLE 3

| | Alloy Composition: Alloy species | Cu (x) | Al (y) | Magnet Properties: Br (kG) | (BH)max (MGOe)* | iHc (kOe)** | Hk (kOe) |
|---|---|---|---|---|---|---|---|
| Ex. 9-1 | I | 0.01 | 0.5 | 11.5 | 31.3 | 16.3 | 13.2 |
| Ex. 9-2 | II | 0.02 | 0.6 | 10.6 | 27.3 | 23.0 | 17.1 |
| Ex. 9-3 | I | 0.06 | 1.0 | 11.1 | 28.4 | 18.0 | 15.0 |
| Comp. Ex. 9-1 | I | 0.00 | 0.1 | 11.8 | 32.7 | 7.8 | 6.4 |
| Comp. Ex. 9-2 | II | 0.00 | 0.2 | 11.0 | 29.1 | 14.4 | 13.1 |
| Comp. Ex. 9-3 | II | 0.09 | 4.0 | 7.9 | 17.6 | 17.8 | 9.8 |

*1 MGOe = 7.96 kJ/m$^3$
**1 kOe = 79.6 kA/m

Example 10

An alloy having a composition of $(Nd_{0.75}Pr_{0.25})_{13.8}Dy_{2.1}Fe_{66.4-x}B_8Co_5Mo_{3.9}Al_{0.8}Cu_x$ (x=0.05 to 0.30 atomic percent) was prepared and further processed to sintered magnets in the same way as in Example 1. The resulting sintered magnets were cooled in a furnace at a cooling rate of approximately 8° to 10° C./min until 800° C. was reached. The coercivity iHc of the sintered magnets in an as-sintered state are shown in Table 4.

TABLE 4

| Cu (atomic %) | iHc (kOe)* |
|---|---|
| 0.05 | 22.2 |
| 0.08 | 23.0 |
| 0.11 | 24.4 |
| 0.13 | 26.8 |
| 0.16 | 27.8 |
| 0.20 | 28.0 |
| 0.30 | 27.5 |

1 kOe = 79.6 kA/m

As shown in Table 4, the presence of a very small amount of Cu provides a very high coercivity i.e., iHc of over 22 kOe even in the as-sintered state, which unnecessitates the heat treatment like ageing etc. thus enabling cost reduction.

Example 11

An alloy having a composition of $Nd_{10.4}Pr_{3.5}Dy_{2.1}Fe_{bal}Co_5B_8Mo_{3.8}Al_{0.3}Cu_x$ (x=0.05 to 0.2 atomic percent) was prepared and further processed to sintered magnets in the same way as in Example 1. The resulting sintered magnets were cooled at different cooling rates, i.e., (a) cooled in an Ar gas flow, (b) cooled in a steady Ar gas atmosphere, and (c) cooled in a furance. The the Cu content x (atomic percent).

Figure 7:
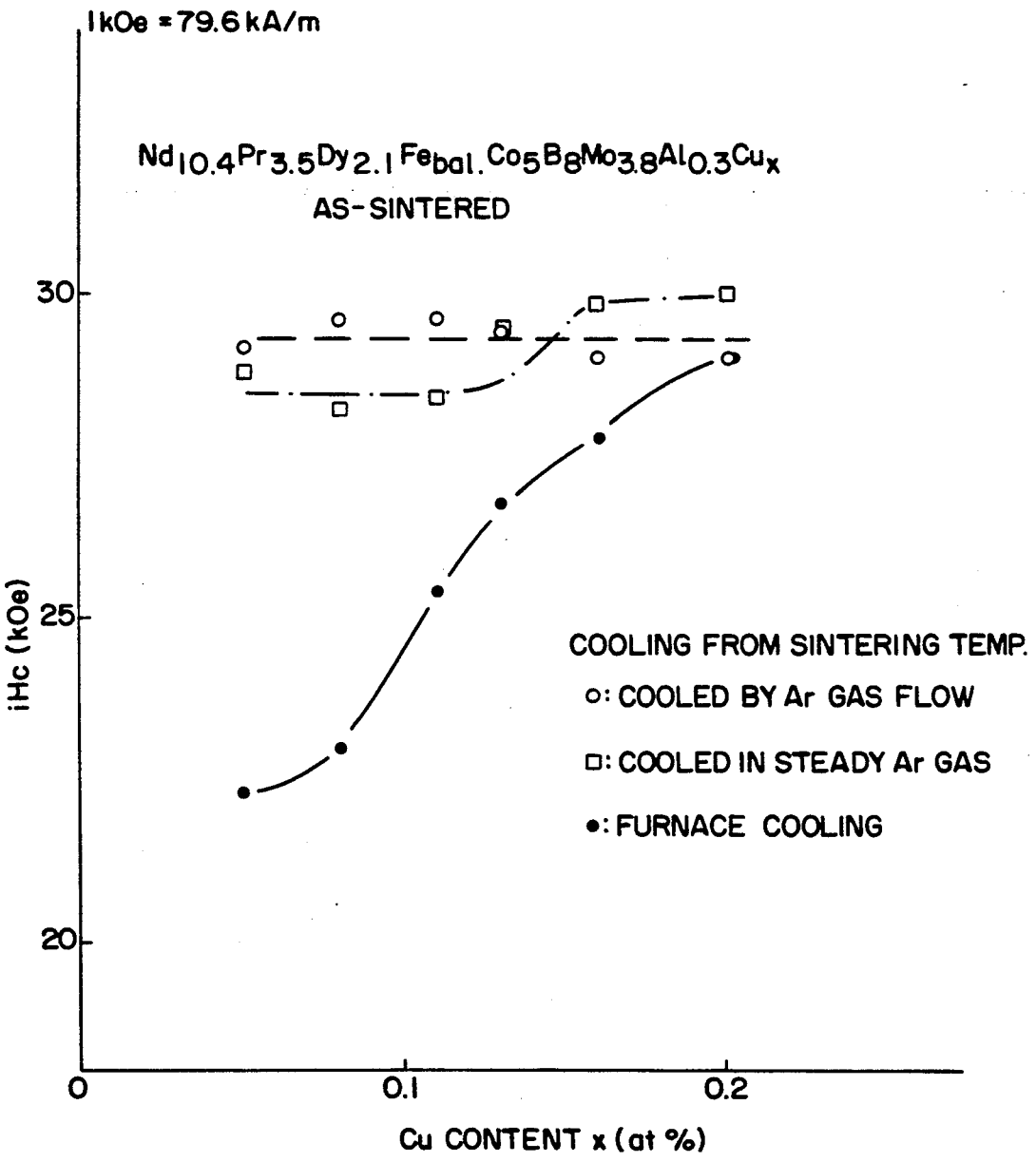
FIG. 7 is a graph showing the relation between coercivity iHc and Cu content depending on different cooling rate after the sintering in the as-sintered state.

As evident from FIG. 7, the cooling in the inert gas atomosphere or gas flow provides the highest coercivity iHc of 28 kOe or higher even at as-sintered state irrespective of the amount of Cu. On the other hand, the furance cooling provides the increasing iHc as the Cu amount increases reaching a maximum of 28 kOe at 0.2 atomic percent Cu.

Thus the presence of Cu in composition with Al stabilizes the coercivity at the highest level, and also unnecessitates the heat treatment for obtaining higher coercivity.

It should be understood that modification may be done without departing from the gist and concept of the present invention as disclosed herein and the scope claimed in the appended claims.

What is claimed is:

1. A permanent magnet having an intrinsic coercivity of at least 15 kOe and a maximum energy product of at least 20 MGOe, consisting essentially of:

12 to 18 atomic percent of R, wherein R is selected from the group consisting of one or more of Pr, Nd, Dy and Tb, and other rare earth elements contained as inevitable impurities, provided that $0.8 \leqq (Pr+Nd+Dy+Tb)/\text{total } R \leqq 1.0$, 5 to 9.5 atomic percent of B, 2 to 5 atomic percent of Mo, 0.01 to 0.5 atomic percent of Cu, and 0.1 to 3 atomic percent of Al, with the balance being essentially Fe.

2. The permanent magnet according to claim 1 wherein, with the amount of B is atomic percent being x and the amount of Mo in atomic percent being y, B and Mo are present in a proportion between B and Mo such that $$(x-4.5) \leqq y \leqq (x-3.0).$$

3. The permanent magnet according to claim 1, wherein Fe is partially replaced by Co in an Co amount of 3 to 7 atomic percent of the entire magnet.

4. The permanent magnet according to claim 1, wherein not more than 90 percent of Mo is replaced by V.

5. The permanent magnet according to claim 2, wherein R is Nd and/or Pr.

6. The permanent magnet according to claim 2, wherein the R is 0 to 3 atomic percent of Dy and/or Tb and the balance being Nd and/or Pr.

7. The permanent magnet according to claim 6, wherein R is 15 to 17 atomic percent, B is 7 to 8 atomic percent and Cu is 0.02 to 0.09 atomic percent.

8. The permanent magnet according to claim 7, wherein Fe is partially replaced by Co in an amount of 3 to 7 atomic percent is the entire magnet.

9. The permanent magnet according to claim 6, wherein Fe is partially replaced by Co in an amount of 4 to 6 atomic percent in the entire magnet.

10. The permanent magnet according to claim 5, wherein B is 6 to 8 atomic percent, and Fe is partially replaced by Co in an amount of 4 to 6 atomic percent in the entire magnet.

11. The permanent magnet according to claim 6, wherein R is 15 to 17 atomic percent, and Fe is partially replaced by Co in an amount of 4 to 6 atomic percent in the entire magnet.

12. The permanent magnet according to claim 3, wherein R is to 0 to 3 atomic % of Dy, and the balance being Nd and/or Pr.

13. The permanent magnet according to claim 5, wherein not more than 90 percent of Mo is replaced by V.

14. The permanent magnet according to claim 11, wherein not more than 90 percent of Mo is replaced by V.

15. The permanent magnet according to claim 12, wherein R is 15 to 17 atomic percent and B is 7 to 8 atomic percent with a coercivity iHc being at least 17 kOe and a maximum energy produce (BH)max being at least 28 MGOe even without the presence of Dy and/or Tb.

16. The permanent magnet according to claim 15, wherein the coercivity iHc further increases as a linear function of the amount of Dy and/or Tb.

17. The permanent magnet according to claim 3, which has a coercivity iHc of at least 21 kOe.

18. The permanent magnet according to claim 3, which has a coercivity of at least 21 kOe in an as-sintered state.

19. The permanent magnet according to claim 3, which has an improved resistance to oxidation characterized by a weight gain rate per unit surface area of uncoated magnet $\Delta W/Wo$ of not more than $1.5 \times 10^{-4}$ g/cm$^2$ when tested under the conditions at a temperature of 80° C. and a relative humidity of 90% for 100 hours.

20. The permanent magnet according to claim 1, which is substantially free of a $Nd_{1+\epsilon}Fe_4B_4$ phase.

21. The permanent magnet according to claim 20, which comprises an (Fe, Mo)-B phase where Mo is predominant in Fe and Mo.

22. The permanent magnet according to claim 3, which is substantially free of $Nd_{1+\epsilon}Fe_4B_4$ phase and comprises an (Fe, Co, Mo)-B phase where Mo is predominant among Fe, Co and Mo.

23. The permanent magnet according to claim 22, which further comprises an $R_m(Fe, Co, Mo)_n$ phase m/n is ½ to 3/1 and Co is predominant among Fe, Co and Mo.

24. The permanent magnet according to claim 21, wherein a $R_2(Fe, Mo)_{14}B$ phase is present as a main phase where Fe is predominant between Fe and Mo.

25. The permanent magnet according to claim 22, wherein a $R_2(Fe, Co, Mo)_{14}B$ phase is present as a main phase where Fe is predominant among Fe, Co and Mo.

26. The permanent magnet according to claim 1, which is an anisotropic sintered permanent magnet.

* * * * *